US008814590B2

(12) United States Patent
Turco et al.

(10) Patent No.: US 8,814,590 B2
(45) Date of Patent: Aug. 26, 2014

(54) ELECTRICAL CONNECTOR FOR FLEXIBLE LED STRIP SEAL

(75) Inventors: Giovanni Turco, Turin (IT); Andrea Gonzo, Turin (IT)

(73) Assignee: Tyco Electronics AMP Italia SRL, Collegno (Torino) (IT)

( * ) Notice: Subject to any disclaimer, the term of this patent is extended or adjusted under 35 U.S.C. 154(b) by 125 days.

(21) Appl. No.: 13/642,448

(22) PCT Filed: Apr. 11, 2011

(86) PCT No.: PCT/EP2011/055614

§ 371 (c)(1),
(2), (4) Date: Oct. 19, 2012

(87) PCT Pub. No.: WO2011/131502

PCT Pub. Date: Oct. 27, 2011

(65) Prior Publication Data

US 2013/0034988 A1 Feb. 7, 2013

(30) Foreign Application Priority Data

Apr. 22, 2010 (IT) ..... TO2010A0341

(51) Int. Cl.
*H01R 4/24* (2006.01)

(52) U.S. Cl.
USPC ..... 439/419

(58) Field of Classification Search
CPC .. H01R 4/2433; H01R 13/506; H01R 4/2404; H01R 12/675; H01R 4/242; H01R 33/22; H01R 33/09
USPC ..... 439/417–419, 404, 422, 425–426; 362/249.01–249.02
See application file for complete search history.

(56) References Cited

U.S. PATENT DOCUMENTS

| | | | | |
|---|---|---|---|---|
| 6,158,882 | A | 12/2000 | Bischoff, Jr. | |
| 6,660,935 | B2 * | 12/2003 | Southard et al. | 362/640 |
| 7,160,140 | B1 | 1/2007 | Mrakovich et al. | |
| 7,210,957 | B2 * | 5/2007 | Mrakovich et al. | 439/404 |
| 7,217,012 | B2 * | 5/2007 | Southard et al. | 362/391 |
| 2008/0076295 | A1 | 3/2008 | Lappoehn | |
| 2008/0137377 | A1 * | 6/2008 | Brengartner et al. | 362/640 |

FOREIGN PATENT DOCUMENTS

WO WO00/19565 4/2000

OTHER PUBLICATIONS

International Search Report and Written Opinion issued by the European Patent Office, dated May 9, 2011, for related International Application No. PCT/EP2011/055614; 10 pages.
International Preliminary report on Patentability, issued by The International Bureau of WIPO, Geneva, Switzerland, dated Oct. 23, 2012, for related International Application No. PCT/EP2011/055614; 6 pages.

* cited by examiner

*Primary Examiner* — Xuong Chung Trans
(74) *Attorney, Agent, or Firm* — Faegre Baker Daniels LLP

(57) ABSTRACT

An electrical connector for a flexible LED strip seal comprises a metal body (9) which clamps an end of the strip of flexible material (2) previously covered by a hood made of flexible material (8), and a contact casing (10) made of plastics material mounted on the metal body (9) and movable relative thereto from a raised inoperative position into a lowered operative position in which the contact elements (14) carried by the contact casing (10) pierce the flexible material of said hood (8) and of said strip (2) and contact conductive pads (6) of a PCB (4) incorporated in the LED seal (2).

6 Claims, 6 Drawing Sheets

ELECTRICAL CONNECTOR FOR FLEXIBLE LED STRIP SEAL

Figure 1:
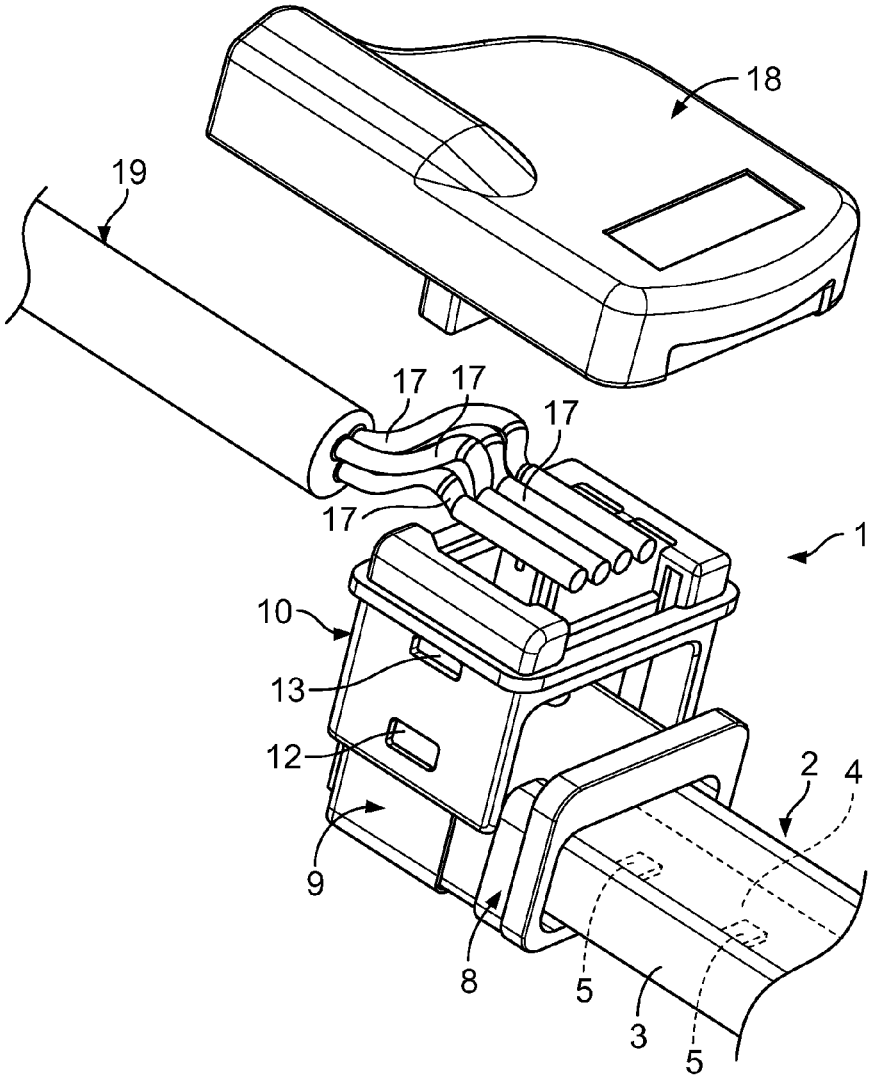

The present invention relates to an electrical connector for a flexible LED strip seal.

Seals of this type comprising a plurality of LED light sources incorporated into a strip of flexible material, for example made of silicone material, which can be used for lighting in various types of application have recently been proposed. Seals of this type comprise a printed circuit board (PCB) which extends over the entire length of the strip, is incorporated in the body of flexible material and includes conductive tracks for powering the LEDs and, at predetermined intervals, conductive pads serving as contact terminals.

The object of the present invention is to produce an electrical connector which makes it possible to provide an electrical connection, in a simple and reliable manner, between a plurality of electrical conductors and the contact pads prearranged on the PCB of the flexible strip.

A further object of the invention is to produce a connector of the aforementioned type which is constructed in a relatively simple and cost-effective manner.

With a view to achieving these objects, the invention relates to an electrical connector of the type specified above, characterised in that it comprises:

- a metal body to be mounted on the strip of flexible material,
- a contact casing made of plastics material mounted on a metal body and movable from a raised inoperative position into a lowered operative position relative to said metal body,
- a plurality of electrical contact elements carried by the contact casing and having piercing ends which pierce the material of the strip and come into contact with said conductive pads of said PCB when the contact casing is moved from its inoperative position into its operative position,
- said metal body and said contact casing having cooperating engagement means which hold them in said operative position so as to ensure the necessary contact pressure between said contact elements and said conductive pads of the printed circuit board.

As a result of the aforementioned features the electrical contact is achieved in the connector according to the invention by a simple contact pressure between the contact elements of the connector and said conductive pads of the PCB incorporated in the strip of flexible material. The same contact elements pierce the flexible material when said contact casing is brought out of its inoperative position into its operative position before pressure-contacting said conductive pads of the PCB. The necessary pressure is guaranteed in time by the fact that the body of flexible material is supported in said metal casing and by the fact that said engagement means are provided which hold the contact casing in its operative position relative to the metal body.

In the preferred embodiment the contact elements are portions of thin metal layers fixed within a wall of said contact casing and each having said piercing end which projects from one side of said wall and an opposite end which projects from the opposite side of said wall and is formed with a seat for receiving a respective conductor.

Still with regard to the above preferred embodiment, a conductor casing for receiving respective heads of a plurality of electrical conductors is provided and said conductor casing is received in a respective seat in the contact casing in an operative position in which said conductors engage in said seats in the contact elements.

Again in the case of the above preferred embodiment, the connector further comprises a hood made of flexible material to be fitted on an end of said strip of flexible material and prearranged so as to be received in said metal body.

Again in the case of the above preferred embodiment, said metal body has a lower wall and two side walls between which an end of the strip of flexible material is received and which are provided on their outer faces with engagement teeth which can each engage selectively in two spaced apertures arranged one above the other and formed in each of two side walls of said contact casing. Furthermore, the metal body preferably also comprises a base wall adapted to form a stop face for the end of said strip of flexible material once this has been mounted in said metal body.

Figure 2:
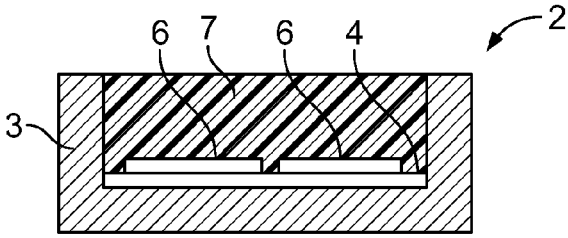
Figure 3:
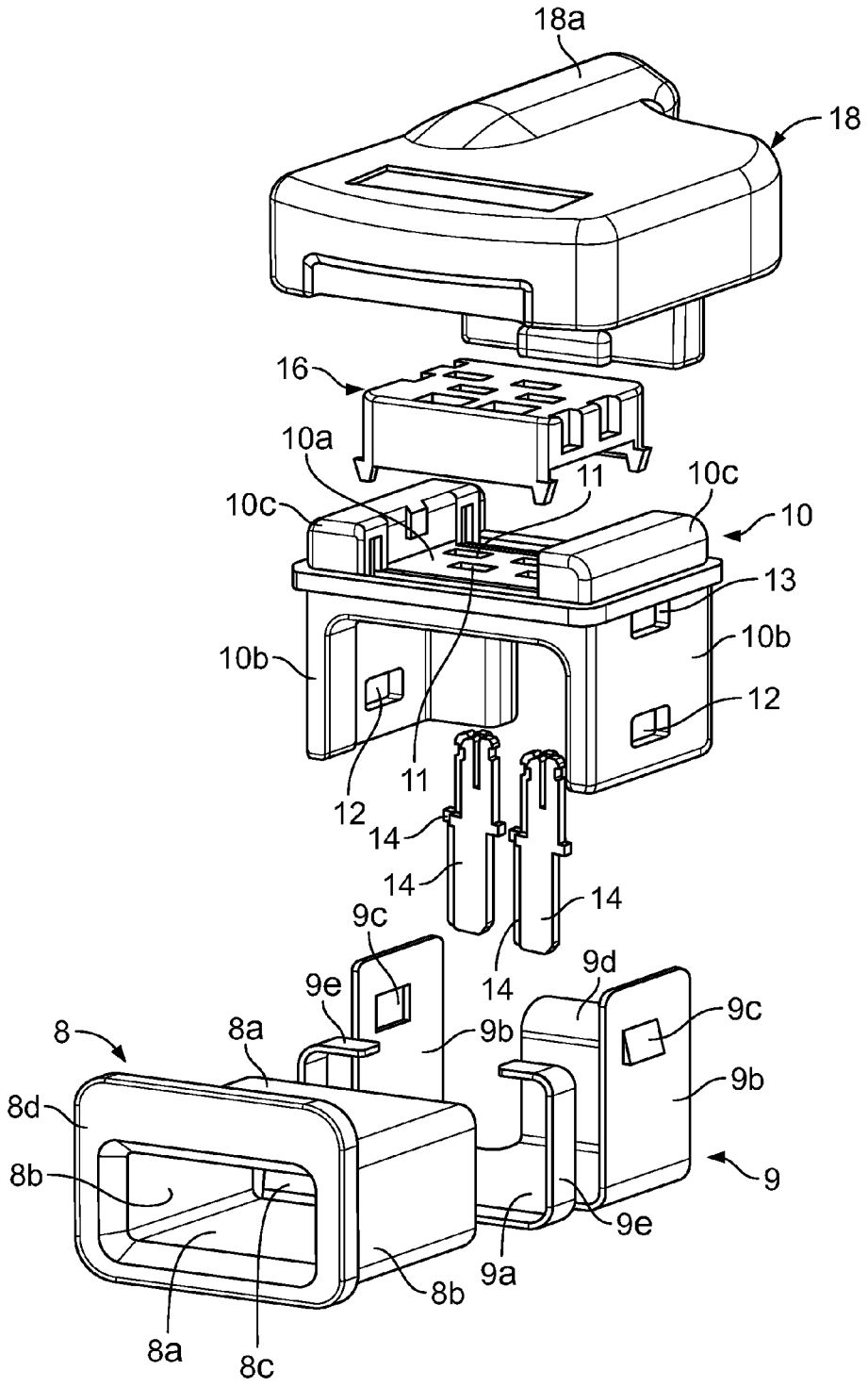
Figure 4:
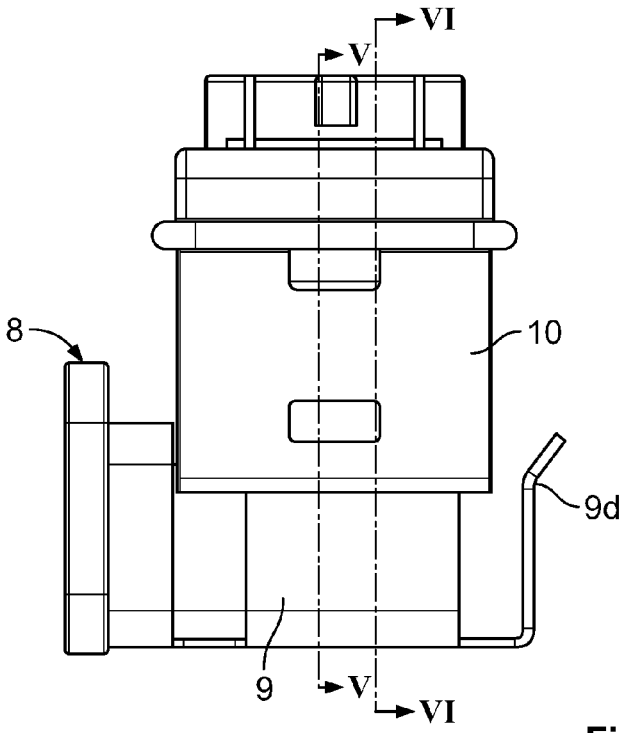
Figure 5:
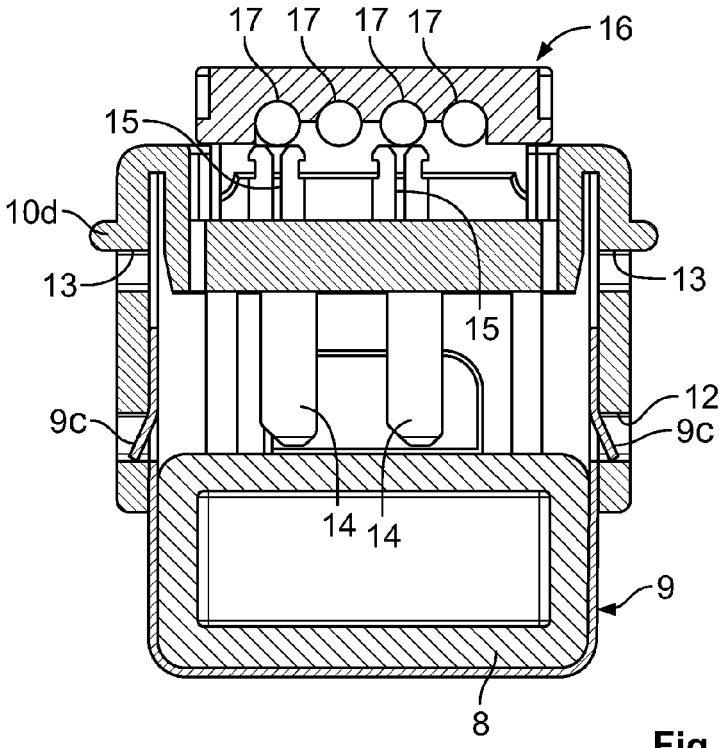
Figure 6:
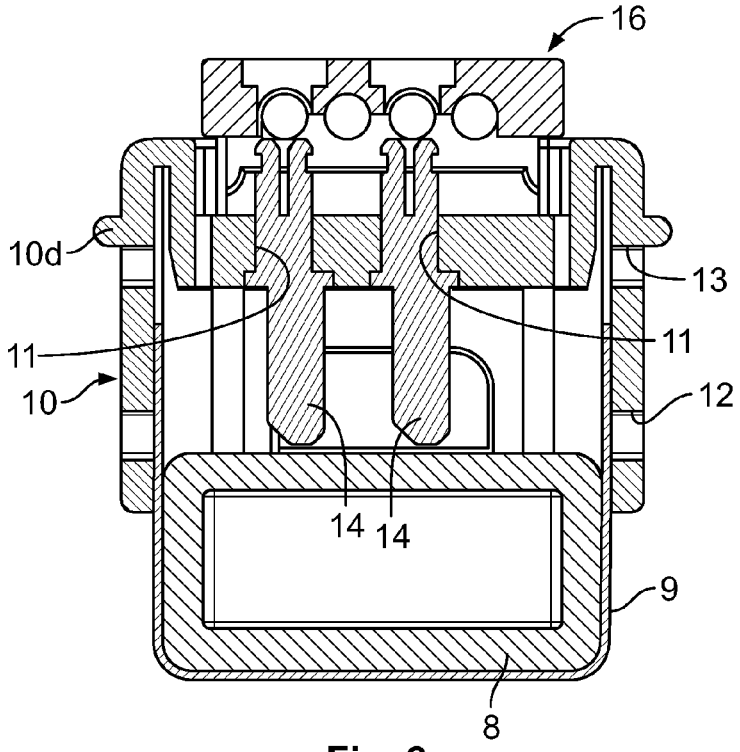
Figure 7:
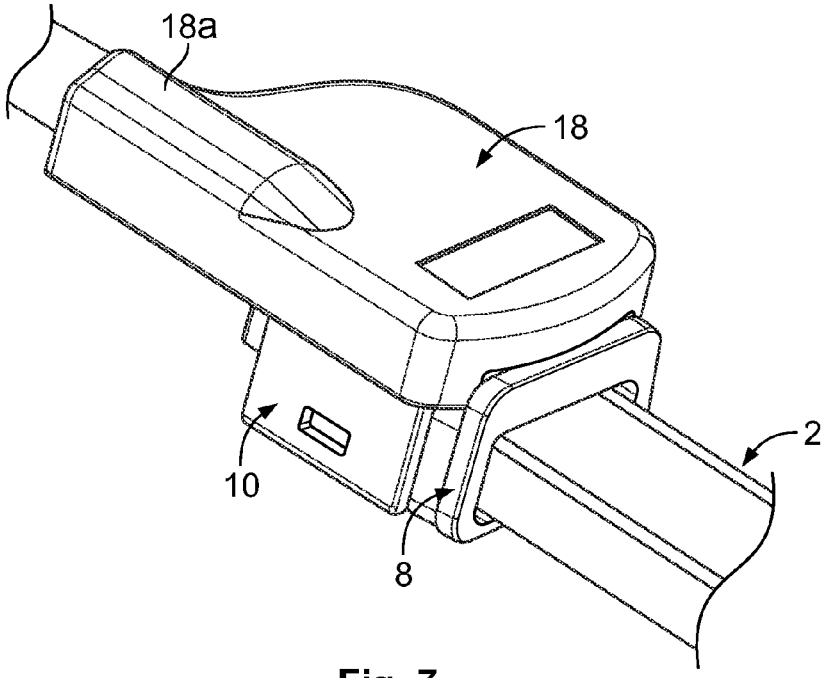
Figure 8:
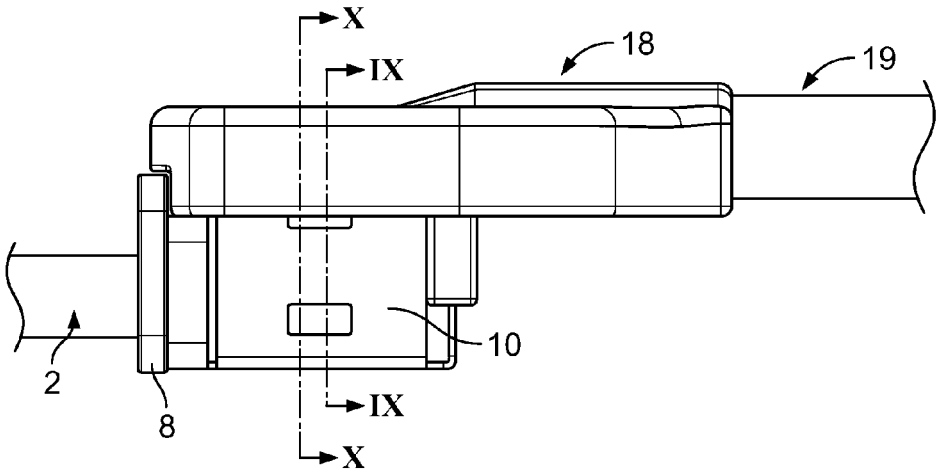
Figure 9:
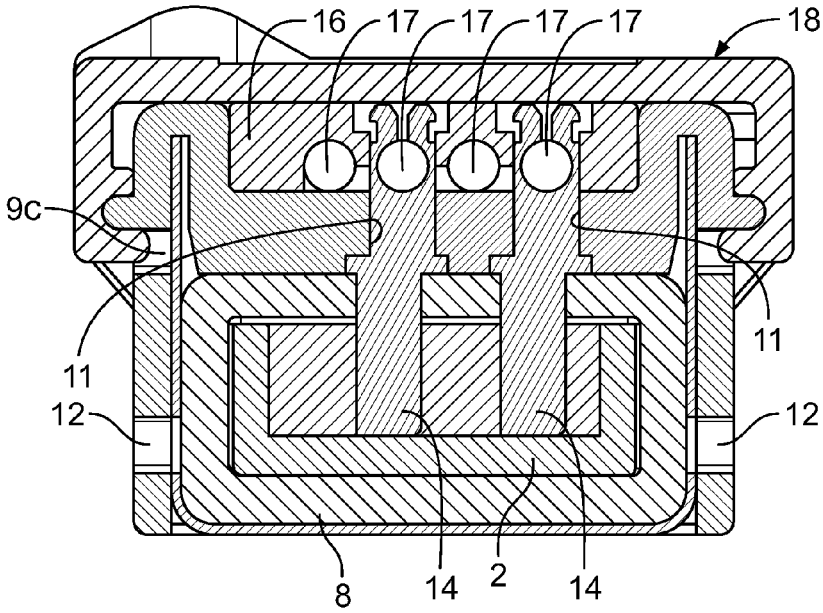
Figure 10:
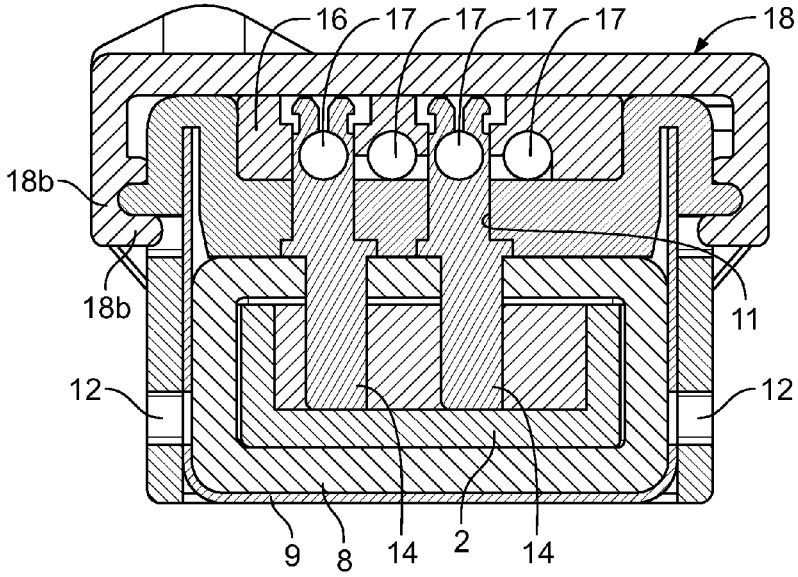
Figure 11:
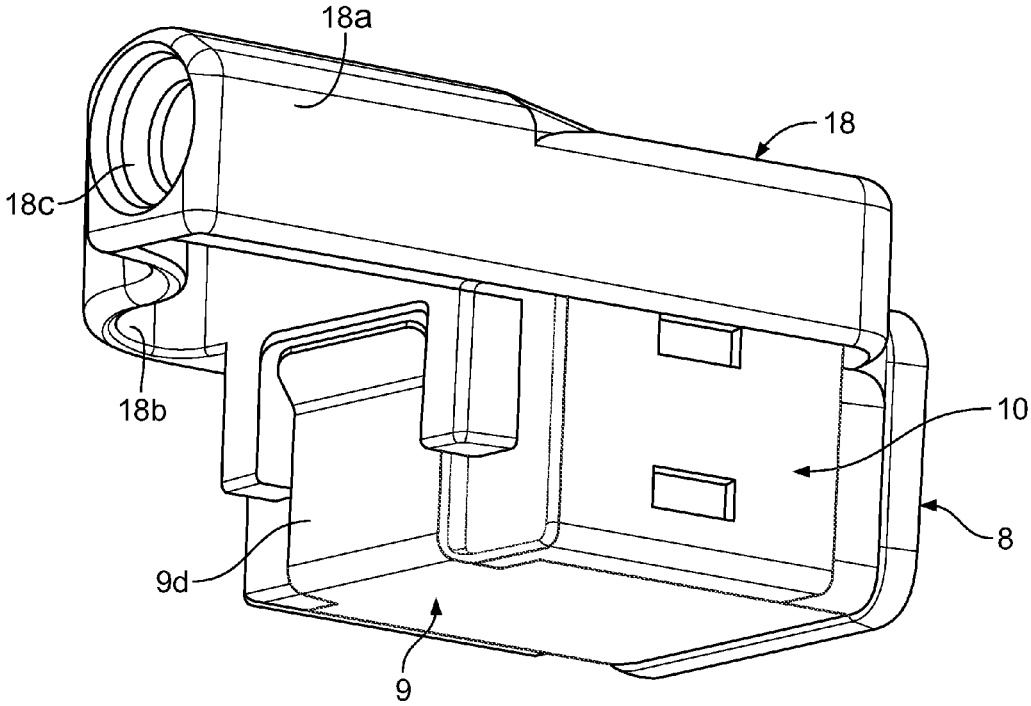

Further features and advantages of the invention will become clear from the following description which is given with reference to the appended drawings which are provided purely by way of non-limiting example and in which:

FIG. 1 is an exploded perspective view of the connector according to a preferred embodiment of the invention, illustrated in its inoperative position and with the conductor casing removed, FIG. 2 is a sectional view of the flexible LED strip seal made of silicone material and incorporating a printed circuit board with conductive pads for connection to the connector according to the invention, FIG. 3 is an exploded perspective view of the connector according to the invention, FIG. 4 is a side view of the connector according to the invention in its inoperative state, FIGS. 5 and 6 are sectional views of FIG. 4 along lines V-V and VI-VI, FIGS. 7 and 8 are a perspective view and a side view of the connector according to the invention in its assembled operative state, FIGS. 9 and 10 are sectional views along lines IX-IX and X-X of FIG. 8, and FIG. 11 is a further perspective view of the connector.

In the drawings reference numeral 1 denotes, as a whole, an electrical connector for a flexible LED strip seal 2 which can be seen in section in FIG. 2. The LED seal 2 comprises, in the case of the embodiment shown here by way of example, a first channel-shaped body made of silicone material 3, on the base wall of which a PCB 4 is prearranged and carries a lined arrangement of LED light sources 5 (see FIG. 1) and conductive tracks (not visible in the drawings) for powering the LEDs 5. The LED seal 2 is prearranged with sets of four conductive pads 6 (two of which can be seen in FIG. 2) prearranged at predetermined intervals along the seal 2 so as to be able to cooperate with the contact elements of a connector according to the invention. The PCB 4 with the conductive tracks and the pads 6 is surrounded by a further (transparent) body made of silicone material 7 which fills the space defined within the channel-shaped body 3. At the time of installation of the LED seal 2, the seal is cut to the desired length in such a way that four conductive pads 6 are arranged adjacent to one end thereof, and the connector according to the invention is mounted on said end so as to connect the four pads to four conductors forming part of the electric power cable (19 in FIG. 1).

With reference to FIG. 3, in the preferred embodiment of the connector according to the invention shown here the connector is equipped with a hood 8, also made of silicone material, to be fitted on the end of the LED strip 2 (see FIG. 1). The hood 8 has planar walls 8*a*, 8*b* (FIG. 3) which are mutually parallel and spaced in pairs, and a base wall 8*c* defining a cavity in which an end of the LED seal 2 is received, as can be seen in FIGS. 1 and 7. The hood 8 also has a front shoulder 8*d* at its mouth.

The connector according to the invention further comprises a metal body 9 for clamping the hood 8 after said hood has been fitted on the end of the LED seal 2. The body 9 is formed of a thin steel sheet bent so as to define a lower wall 9*a*, two side walls 9*b* each prearranged with engagement teeth 9*c* projecting outwardly and formed by cutting and bending, and a base wall 9*d* having an outwardly bent upper edge (see also FIG. 4 and FIG. 11) and two auxiliary side clamping arms 9*e*.

The teeth 9*c* constitute engagement elements for connection of a contact casing 10 made of plastics material to said metal body 9. The contact casing 10 has an upper wall 10*a* penetrated by four slits 11 for receiving four contact elements, as will be described in greater detail hereinafter. The plastics material body of the contact casing 10 further comprises two side walls 10*b*, each of which has spaced apertures 12, 13 arranged one above the other for selectively receiving the engagement teeth 9*c* of the metal body 9.

The electrical connector according to the invention is initially prearranged in an inoperative state in which the engagement teeth 9*c* of the metal body 9 are engaged in the lower apertures 12 in the contact casing 10, the casing 10 being held on the metal body 9 in a raised inoperative position. As will be illustrated below, the casing 10 is then lowered into an operative position in which the engagement teeth 9*c* engage in the upper apertures 13 of the contact casing 10.

FIG. 5 shows a sectional view of the contact casing 10 with the engagement teeth 9*c* of the metal body 9 engaged in the lower apertures 12. As can be seen in FIGS. 6, 9 and 10, the four slits 11 which penetrate through the upper wall 10*a* of the casing 10 receive, with an interference fit, four thin conductive metal layers, for example formed of a copper alloy, each having a portion 14 constituting a contact element of the connector according to the invention which projects downwardly from the upper wall 10*a* of the contact casing 10. As can be seen in FIGS. 5 and 6, when the contact casing 10 is mounted on the metal body 9 in its raised inoperative position, the ends of the contact elements 14 are above the upper wall 8*a* of the hood 8 covering the end of the strip 2 and received in the metal body 9.

Again with reference to FIGS. 5, 6, 9 and 10, the thin metal layers defining the contact elements 14 have portions projecting upwardly from the upper wall 10*a* of the casing 10, denoted as a whole by reference numeral 15. The portions 15 have an axial incision extending from their end and defining a seat adapted to receive a respective electrical conductor. The two wings defined by said incision are shaped so as to cut and remove the insulating coating of the electrical conductor when it is inserted between them.

With reference to FIG. 3, the connector according to the invention also has a conductor casing 16 which is made of plastics material and has seats prearranged to receive four electrical conductors 17, one of such conductors 17 being used to power the LEDs 5 and the other three conductors 17 being used to transmit the signals corresponding to the red, yellow and blue colours of the LED light sources. Of course, this solution is given purely by way of example and it is clear that there may be any number of electrical conductors depending on the specific embodiment of the LED strip.

In the assembly, the conductors 17 are first inserted into the seats in the conductor casing 16, each conductor being formed by a strand of conductive material surrounded by an insulating sheathing. The conductor casing 16 is then mounted in a seat defined between two end protrusions 10*c* projecting from the upper wall 10*a* of the contact casing 10. In this state, the portions 15 receive the conductors 17, automatically removing the insulating sheathing and placing the conductors themselves in electrical contact with the contact elements 14.

With reference to FIGS. 3 and 11, the connector according to the invention lastly comprises a hood made of flexible material 18 which has a peripheral base edge 18*b* (see FIGS. 9 and 10) hooked over a projecting edge 10*d* of the contact casing 10 (see also FIG. 3) and which protects the upper part of the casing 10 and the conductor casing 16. The hood made of silicone material 18 also has a connection 18*a* with an opening 18*c* (see FIG. 11) for receiving the cable 19 (see FIG. 1) from which the conductors 17 emerge.

In the final configuration of the connector, after assembly on the LED seal, the plate 8*d* of the hood made of silicone material 8 abuts a front face of the hood 18 (see FIGS. 7 and 8) and the base wall 9*d* of the metal body 9 is in contact with the base wall of the hood 8 (see FIG. 11).

As is evident from the description above, the connector according to the invention is initially prearranged with the conductors 17 mounted in the conductor casing 16 (see FIGS. 5 and 6), after which said conductor casing 16 is pushed into its final position on the contact casing 10 so as to create the electrical connection between the conductors 17 and the portions 15 of the contact elements of the connector, with automatic removal of the insulating sheathing of the conductors 17. The contact casing 10 is then prearranged in its raised inoperative position on the metal body 9 by engagement of the teeth 9*c* in the lower apertures 12 of the contact casing 10. In this state, one end of the LED strip 2, with the hood 8 fitted thereon, is mounted in the metal body 9 with an interference fit. The strip is inserted into the body 9 until the base wall 8*c* of the hood 8 abuts the base wall 9*d* of the metal body 9, the resilience of the side walls 9*b* and of the auxiliary arms 9*e* of the metal body 9 ensuring that the LED seal 2 is fixed in position. The device is thus in the state shown in FIGS. 5 and 6. Starting from this state, the contact casing 10 is pressed toward the base in such a way that the sharp ends of the contact elements 14 pierce the upper wall 8*a* of the hood made of silicone material 8 as well as the silicone material forming the body 7 (FIG. 2) of the LED seal 2 until they come into contact with the conductive pads 6 prearranged on the PCB 4. In this state the engagement teeth 9*c* engage with the upper apertures 13 in the contact casing 10 so as to hold, in this position, the casing 10 on the metal body 9 which, via its lower wall 9*a*, ensures the resistance necessary to guarantee that the pressure contact is maintained between the contact elements 14 and the pads 6 (FIGS. 9 and 10).

Naturally, the principle of the invention remaining the same, the forms of embodiment and details of construction in particular may be varied widely with respect to those described and illustrated, which have been given purely by way of example, without thereby departing from the scope of the invention.

The invention claimed is:

1. Electrical connector for an LED strip seal, the LED strip seal comprising a body made of flexible material, made of silicone material, in which a printed circuit board (PCB) is incorporated which carries conductive tracks for powering the LEDs and conductive pads serving as contact terminals, said connector comprising:

a metal body to be mounted on the strip of flexible material;

a contact casing made of plastics material mounted on the metal body and movable from a raised inoperative position into a lowered operative position relative to said metal body; and a plurality of electrical contact elements carried by the contact casing and having piercing ends which pierce the material of said strip and come into contact with said conductive pads of the PCB when the contact casing is moved from the raised inoperative position into the lowered operative position;

said metal body and said contact casing having cooperating engagement means which hold them in said operative position so as to ensure the necessary contact pressure between said contact elements and said conductive pads.

2. Connector according to claim 1, wherein the contact elements are portions of thin metal sheets fixed within a wall of said contact casing and each having said piercing end which projects from one side of said wall and an opposite end which projects from the opposite side of said wall and is formed with a seat for receiving a respective conductor.

3. Connector according to claim 1, wherein said connector further comprises a conductor casing for receiving said conductors cooperating with said contact elements, said conductor casing being mounted in a seat in said contact casing in a position in which said conductors are received in said seats in the contact elements.

4. Connector according to claim 1, wherein it further comprises a hood made of flexible material to be fitted on an end of said strip of flexible material and prearranged so as to be received in said metal body.

5. Connector according to claim 4, wherein said metal body has a lower wall and two side walls between which an end of the strip of flexible material is received and which are provided on their outer faces with engagement teeth which can each engage selectively in two spaced apertures arranged one above the other and formed in each of two side walls of said contact casing.

6. Connector according to claim 5, wherein said metal body also comprises a base wall adapted to form a stop face for the end of said strip of flexible material once this has been mounted in said metal body.

* * * * *